US005734998A

United States Patent [19]

Simmons

[11] Patent Number: 5,734,998

[45] Date of Patent: Apr. 7, 1998

[54] TOILET TRAINING DEVICE

[76] Inventor: Teresa Simmons, 354 N. High, Wichita, Kans. 67203

[21] Appl. No.: 740,331

[22] Filed: Oct. 31, 1996

[51] Int. Cl.[6] ..... A47K 11/04

[52] U.S. Cl. ..... 4/476; 4/483

[58] Field of Search ..... 4/449, 474–479, 4/483, 902

[56] References Cited

U.S. PATENT DOCUMENTS

| | | | |
|---|---|---|---|
| 341,135 | 5/1886 | Ellison | 4/483 X |
| 550,613 | 12/1895 | Harvey | 4/483 X |
| 928,107 | 7/1909 | Collings | 4/483 X |
| 1,947,940 | 2/1934 | Isom | 4/483 X |
| 3,343,179 | 9/1967 | Sellars, Jr. et al. . | |
| 5,083,325 | 1/1992 | Vitullo | 4/479 |
| 5,575,021 | 11/1996 | Harris | 4/449 |

FOREIGN PATENT DOCUMENTS

| | | | |
|---|---|---|---|
| 0014839 | of 1886 | United Kingdom | 4/476 |

*Primary Examiner*—Charles E. Phillips

*Attorney, Agent, or Firm*—Hovey,Williams, Timmons & Collins

[57] ABSTRACT

A toilet training device (20) is provided, preferably configured as a simulation of an antique railroad engine. The device (20) includes a toilet training bowl (56) supported within a housing (22) with a cover (24) mounted for selective movement thereof between a covering position over the bowl (56) and a retracted position adjacent the housing (22), so as to allow access to the housing (22) and bowl (56) for toilet training purposes. A secondary supply chamber (26) is also provided having a pivotal top (28), for the storage of toys or toilet training needs. The bowl (56) supports a lift-off apertured panel (54) which may be removed for use on a conventional adult toilet. The bowl (56) is also removable from the device (20) after toilet training is completed, so that the device (20) may be used as a toy.

16 Claims, 3 Drawing Sheets

TOILET TRAINING DEVICE

BACKGROUND OF THE INVENTION

1. Field of the Invention

The present invention is broadly concerned with an improved child's toilet training device of compact construction and providing visual and structural features which enhance a child's toilet training experience. More particularly, the invention pertains to a training device which in preferred forms has an external configuration simulating a railroad train engine, with a toilet training bowl removably supported within the "cab" portion of the engine, together with an auxiliary supply chamber within the "motor" section of the engine. The bowl housing and chamber are provided with liftable arcuate covers.

2. Description of the Prior Art

Toilet training of children can be a difficult experience for both the parents and children themselves. From a parent's perspective, the goal is to properly toilet train the child with as little time and trouble as necessary, while making the overall experience a positive one. Toilet training aids have been proposed in the past, see, e.g., U.S. Pat. Nos. 3,343,179 and D345,202. The '179 patent describes a strictly utilitarian chair device adapted to be mounted on a conventional toilet. The '202 patent describes a free-standing toilet training chair, but again does not include any features of interest for a child.

In addition, once a child has been properly toilet trained, there is generally nothing further which can be done with the prior training devices. That is to say, the toilet training aids of the prior art, owing to their single functional utility and lack of any aesthetic dimension, have no additional utility after the child's toilet training experience.

There is accordingly a need in the art for an improved toilet training device which provides not only the necessary functional features, but also has a configuration which will attract the interest of a child, thus making the child more eager to initiate and complete the toilet training experience. Furthermore, it would be desirable that a toilet training device be usable as a toy after the child has been toilet trained.

SUMMARY OF THE INVENTION

The present invention overcomes the problems outlined above, and provides a toilet training device preferably having the look of a simulated railroad engine. Broadly speaking, the device of the invention includes a toilet training bowl together with means for supporting and removably covering the bowl, and for allowing selective access thereto by a child to be toilet trained. The supporting and cover means includes walls defining an upright, open top housing for removably supporting the bowl therein, and a cover; means operably couples the cover to the housing for selective movement of the cover between an extended position in covering relationship over the bowl and a retracted position allowing a child to sit above the bowl. This coupling means comprises structure for translatory, shifting movement of the cover between extended and retracted positions thereof. In preferred forms, the housing and bowl are situated in the "cab" portion of the simulated engine, with the cover having the arcuate in cross-section configuration characteristic of an antique steam engine. In order to minimize the space requirements for the device, the cover coupling means advantageously includes structure defining an elongated, upright slot in the housing, and pin means carried by the cover and slidable within the slot. In this fashion, the cover is pivotal during translatory movement thereof about an axis transverse to the longitudinal axis of the cover member.

The overall training device also preferably include structure defining an open top supply chamber adjacent and connected to the housing, together with a top for the supply chamber and hinge means operatively securing the top to the supply chamber-defining structure. In more detail, upright, opposed, spaced apart panels are employed to define the chamber, and the hinge means is adapted for selective and alternate coupling to a pair of oppositely disposed panels, whereby the supply chamber top may be opened in opposite directions at the discretion of the user. Preferably, the supply chamber is situated at the "motor" portion of the simulated railroad engine, with the top for the chamber being arcuate in cross-section and disposed below the housing cover. The storage chamber is adapted for holding toys or toilet training necessities.

After a child has been toilet trained using the device of the invention, it is only necessary to remove the training bowl and related structure, and the entire device can be used as a toy. If desired, removable wheels can be provided so that the device is mobile and more readily can be used as a toy after its primary function has been completed.

DETAILED DESCRIPTION OF THE PREFERRED EMBODIMENT

Figure 2:
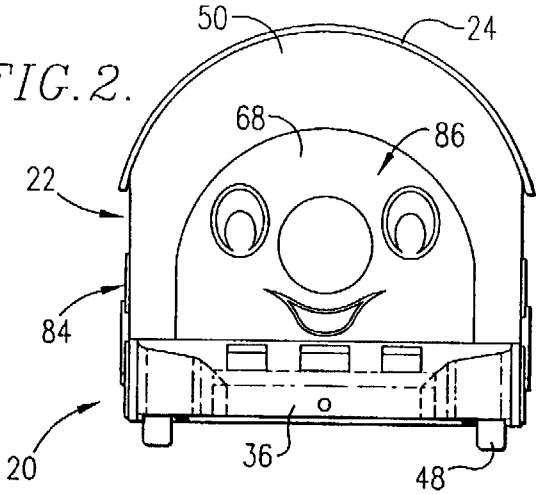
FIG. 2 is a front view thereof.
Figure 3:
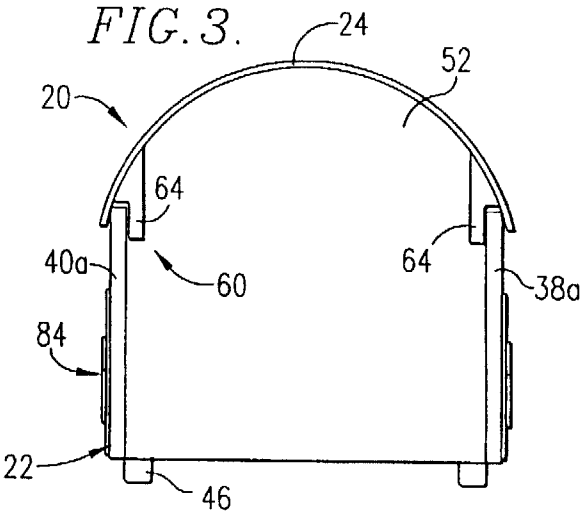
FIG. 3 is a rear view thereof.
Figure 1:
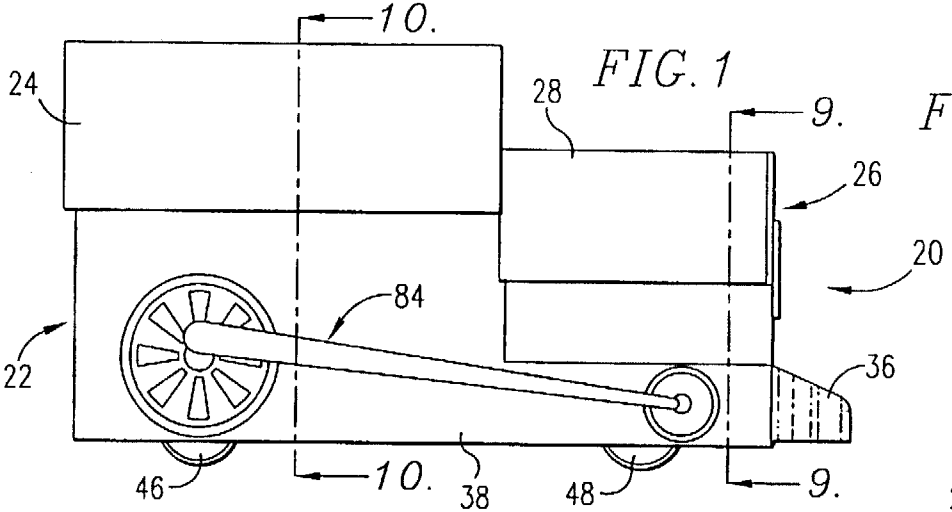
FIG. 1 is a side view of a toilet training device in accordance with the invention.
Figure 4:
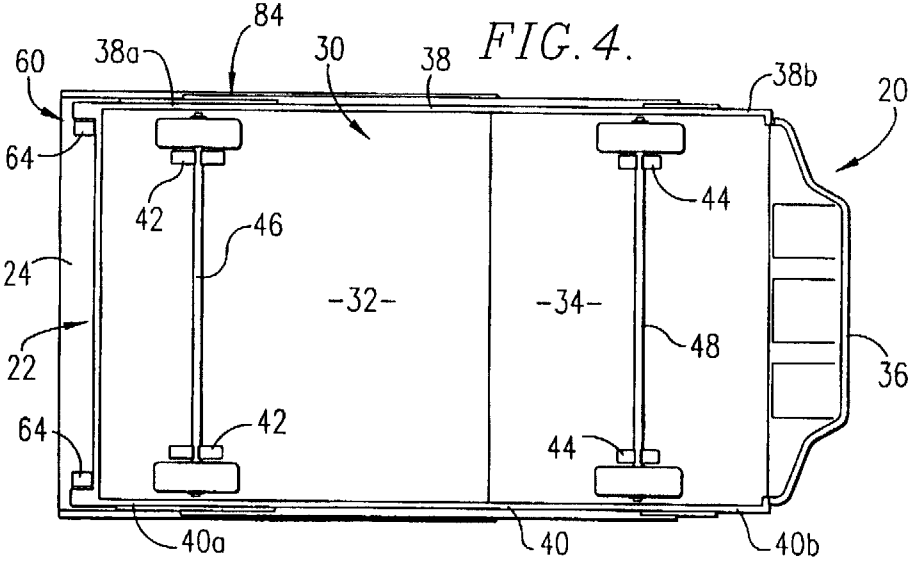
FIG. 4 is a bottom view thereof.
Figure 5:
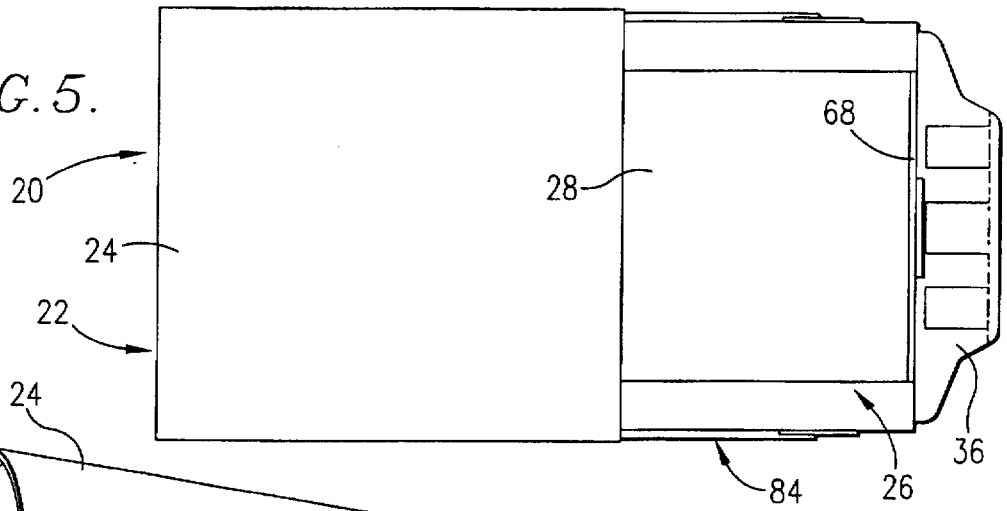
FIG. 5 is a top view thereof.
Figure 8:
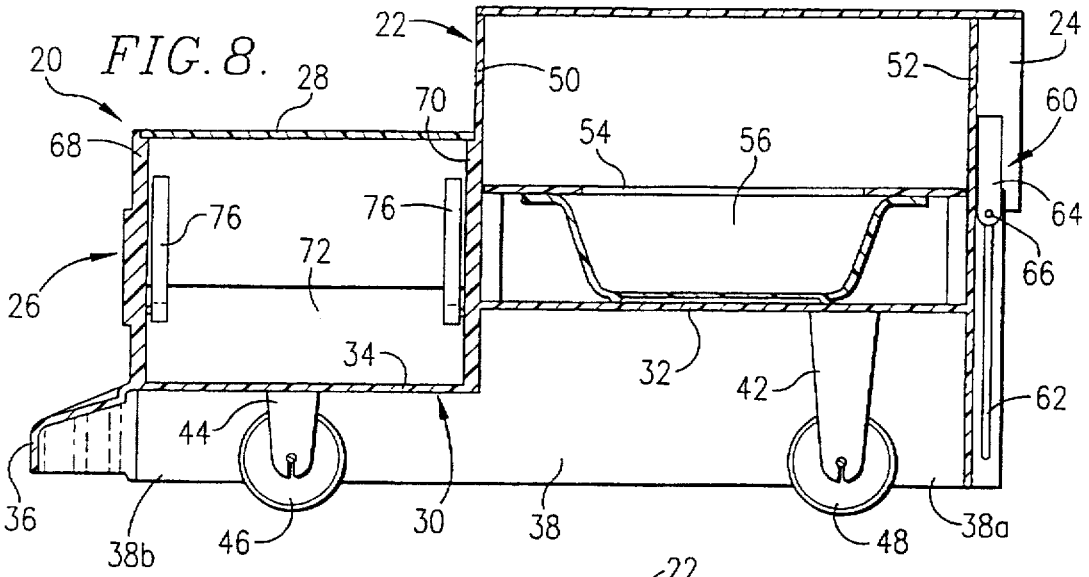
FIG. 8 is a vertical sectional view of the toilet training device illustrating the internal construction thereof.
Figure 9:
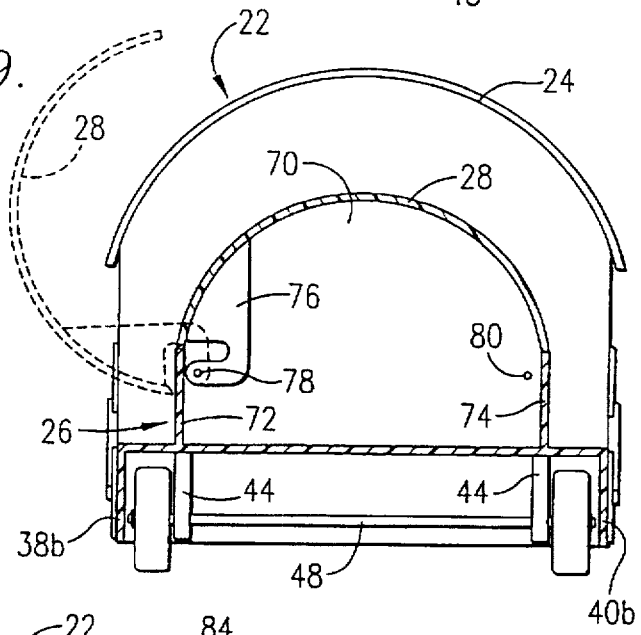
FIG. 9 is a vertical sectional view taken along line 9—9 of FIG. 1 and illustrating the detailed construction of the auxiliary supply chamber, wherein the supply chamber top is illustrated in its closed position in bold lines and in its opened position in phantom.

Turning now to the drawings, a toilet training device 20 in accordance with the invention has the general configuration of a simulated antique railroad engine and includes a primary toilet training bowl housing 22 provided with an arcuate cover 24, together with an attached, secondary supply chamber 26 having an openable top 28. As best seen in FIGS. 1 and 8, the primary housing 22 occupies the "cab" portion of the simulated engine, whereas the supply chamber 26 is situated at the "motor" portion thereof.

Figure 6:
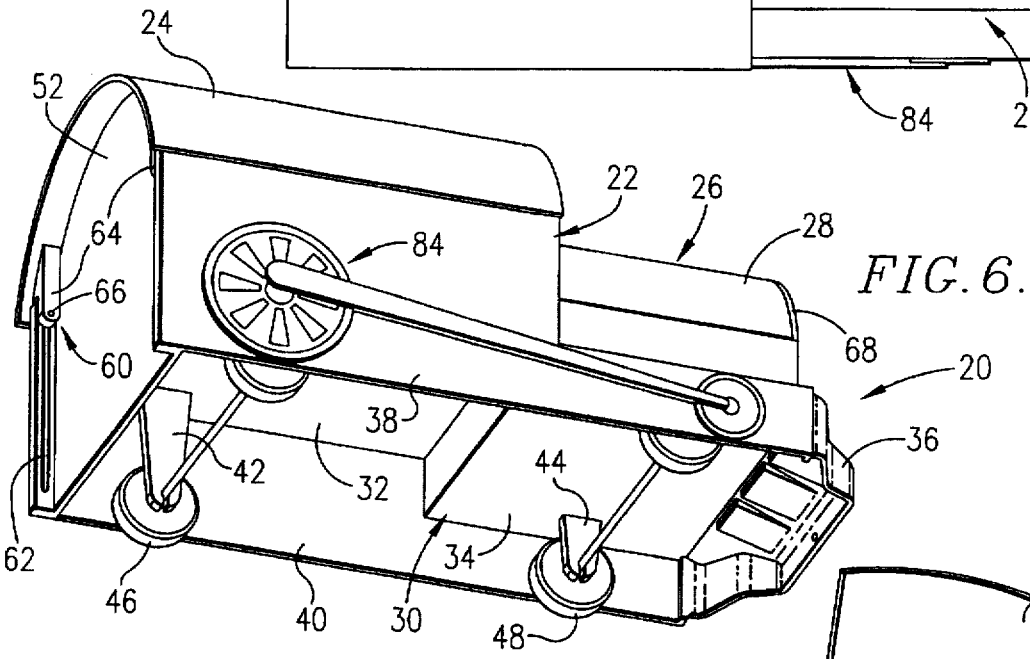
FIG. 6 is a perspective view thereof illustrating the underside and rear of the toilet training device.

In more detail, the device 20 includes a bottom wall 30 presenting an upper rearward portion 32 and a lower forward portion 34 terminating in a simulated "cow catcher" panel 36 defining the forwardmost end of the device. In addition, a pair of side panels 38, 40 are secured to the bottom wall 30 as shown. Each of the side panels 38, 40 includes a rearward portion 38*a*, 40*a*, and a shorter, forwardly extending portion 38*b*, 40*b* extending toward and joining the margins of cow catcher panel 36. In order to render the device 20 mobile, a pair of laterally spaced apart, depending struts 42 are secured to the underside of bottom wall portion 32, whereas a similar pair of spaced apart, depending struts 44 are secured to bottom wall portion 34. Respective wheel pairs 46, 48 are releasably secured within the strut pairs 42, 44 as best seen in FIG. 6. As best illustrated in FIG. 1, the peripheries of the wheel pairs 46, 48 extend slightly below the lower margins of the side panels 38, 40.

Figure 10:
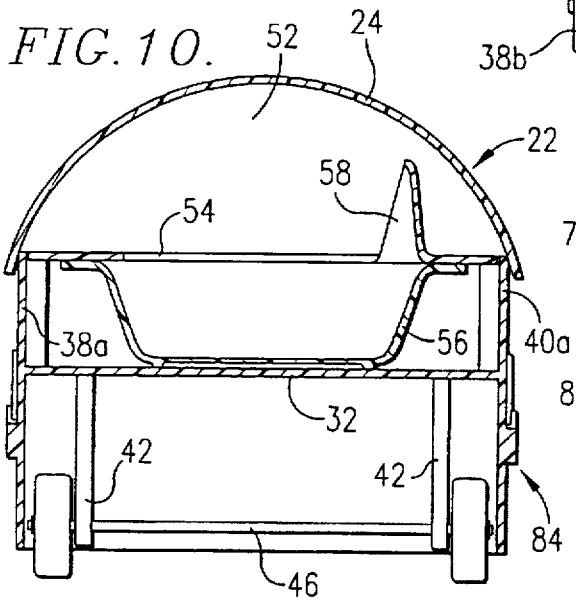
FIG. 10 is a vertical sectional view taken along line 10—10 of FIG. 1 and illustrating the internal construction of the bowl and housing portion of the device.

The housing 22 is made up of the side panel portions 38*a*, 40*a*, as well as opposed front and rear housing walls 50, 52. Referring to FIG. 8, it will be observed that front wall 50 is interconnected with the bottom wall portions 32, 34, and has an arcuate uppermost margin. Rear wall 52 is secured to the side panels 38, 40 and likewise has an arcuate upper margin. The housing 22 further includes an apertured, lift-off top or seat panel 54 having rounded corners and with an upstanding deflector 58. As best illustrated in FIG. 10, a training bowl 56 rests atop the rear portion 32 of bottom wall 30 in registry with the opening in panel 54, and supports the panel 54 together with a plurality of spaced, upright, marginal support members. Note that the front, rear and side margins of the panel 54 being closely adjacent upstanding front and rear walls 50, 52 and side panel portions 38*a*, 40*a*. In this fashion, the panel 54 and bowl 56 can be removed from the housing as needed. If desired, rubber seat bumpers (not shown) can be provided on the underside of panel 54 to permit location of the panel 54 on a conventional adult toilet seat.

Figure 12:
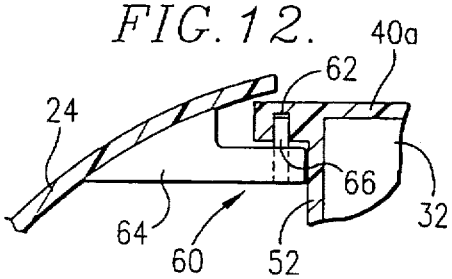
FIG. 12 is a fragmentary sectional view depicting the preferred coupling between the cover and bowl housing.

The cover 24 is arcuate in configuration and is designed to completely cover the housing 22. To this end, the cover 24 has an arcuate configuration which mates with the upper margins of the walls 50, 52, whereas the side margins of the cover 24 slightly overlap the upper edges of the side panel portions 38*a*, 40*a*. In order to permit opening of the cover 24, a coupling assembly 60 is provided. This coupling assembly includes a pair of opposed, upright slots 62 provided along the inner surfaces of the side panel portions 38*a*, 40*a* (FIGS. 6 and 8), with a pair of pin mounts 64 secured to the underside of cover 24. Each of the pin mounts 64 includes a laterally outwardly extending pin 66 (FIG. 12) which is slidably received within a corresponding slot 62. In this manner, the cover 24 may be lifted from its FIG. 8 position and pivoted upwardly about a pivot axis defined by the pins 66 (i.e., a pivot axis transverse to the longitudinal axis of the cover 24) with the pin 66 sliding downwardly in the slots 62 so as to bodily translate the cover 24 to an upright retracted position illustrated in FIG. 7. It will be appreciated that the coupling assembly 60 thus permits the cover 24 to be stowed in its retracted position closely adjacent the rearward end of the device 20 and out of interfering relationship with the housing 22. Moreover, this type of coupling assembly permits opening and closing of the cover 24 using only a minimum of space.

The supply chamber 26 includes upstanding front and rear walls 68, 70, the latter being integral with or attached to front wall 50 of housing 22, as well as short upstanding sidewalls 72, 74. It will be seen that the front and rear walls 68, 70 are of arcuate configuration, similar to the walls 50, 52 described previously. The bottom wall for the chamber 26 is defined by the forward portion 34 of wall 30.

Figure 11:
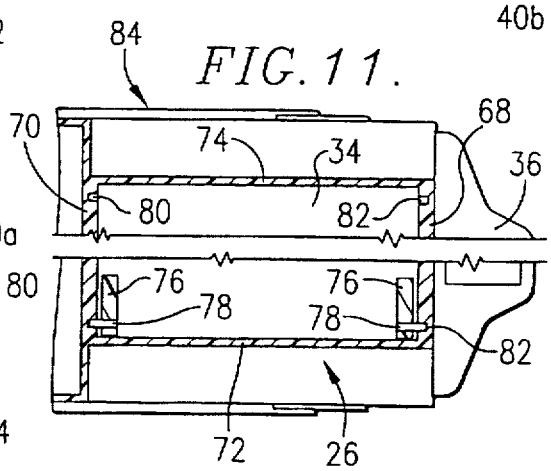
FIG. 11 is a fragmentary sectional view depicting the hinge assembly for coupling the top and supply chamber.

The top 28 is an arcuate member having a radius substantially conforming with the upper margins of the wall 68, 70 which is designed for pivotal opening about an axis essentially parallel with the longitudinal axis thereof (and thus transverse to the pivot axis for the cover 24). Referring to FIGS. 10 and 11, it will be seen that the top 28 is provided with a pair of spaced, fore and aft, slotted pivot blocks 76. Each block 76 includes an outwardly extending pivot pin 78 which is received within associated opening 80, 82 provided in the inner surface of the front and rear walls 68, 70, respectively. In preferred forms, the top 28 may be secured adjacent either panel 72 or panel 74, so as to permit left or right-hand opening thereof. Thus, the front and rear walls 68, 70 have a pair of openings 80, 82 adjacent each of the upstanding panels 72, 74. In order to change the cover mounting, it is only necessary to inwardly deflect the blocks 76, thus pulling the associated pins 78 out of the opening pair 80, 82, followed by reversing the top 28 and reinstalling the latter using the opposite side opening pair 80, 82. As the top 28 is opened, the slots provided in the blocks 76 receive the upper margin of the associated panel 72, 74, thus supporting the top 28 in its opened position.

In order to achieve a desired aesthetic effect, the side panels 38, 40 are preferably provided with a simulation of engine driving wheels, as illustrated at 84. These may be painted or decaled onto the side panels or as shown be provided as three dimensional decorations. The front wall 68 of the chamber 26 may similarly be decorated with facial features as illustrated at 86.

Figure 7:
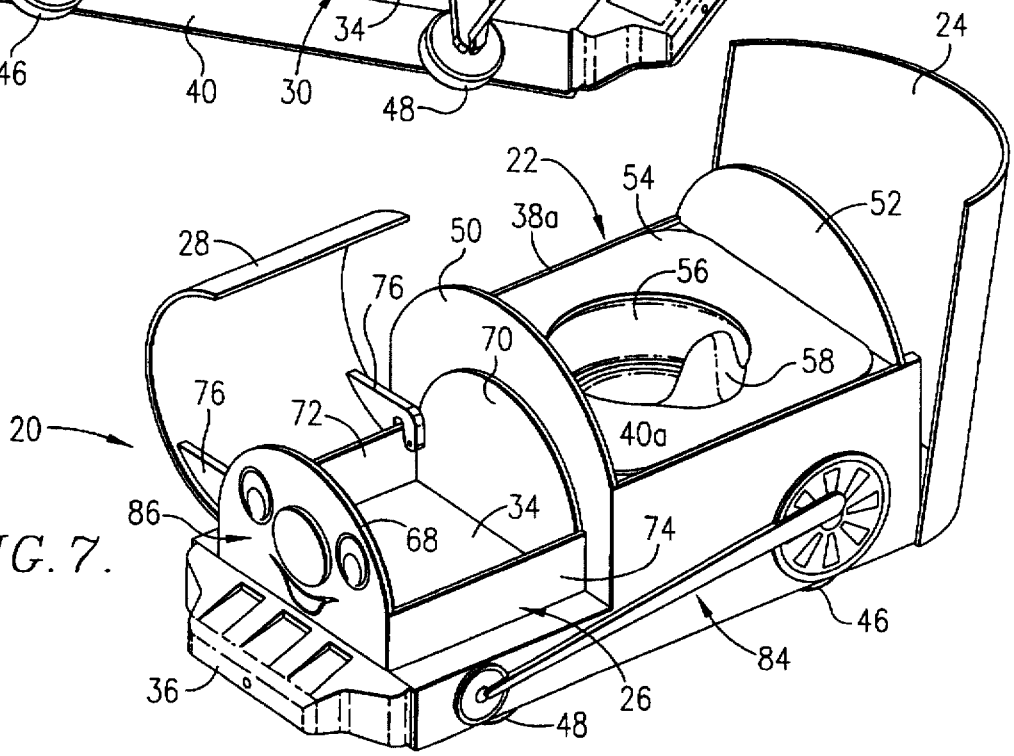
FIG. 7 is a perspective view illustrating the front and side of the toilet training device, depicting the cover and top of the device in their open, retracted positions.

In the use of device 20, the cover 24 is pivoted and translated from its covering position depicted in FIG. 1 to its retracted position illustrated in FIG. 7. This provides open access so that a child may sit upon panel 54 above bowl 56. As indicated, training supplies or toys may be positioned within chamber 26, and to this end, the top 28 may be opened as shown in FIG. 7. Once a child has completed his or her toilet training, the bowl 56 and liftoff seat panel 54 can be permanently removed from the housing 22, whereupon the device 20 may be used as a pleasing toy by the child.

I claim:

1. A child's toilet training device comprising:

a toilet training bowl; and means for supporting and removably covering said bowl, and for allowing selective access thereto by a child to be toilet trained, said supporting and covering means including— walls defining an upright, open-top housing for removably supporting said bowl therein;

a cover comprising an elongated, arcuate in cross-section member; and means operably coupling said cover to said housing for selective movement of the cover between an extended position in covering relationship over said bowl and a retracted position allowing a child to sit above the bowl, said coupling means comprising structure for translatory, shifting movement of said cover between said extended and retracted positions thereof, said coupling means comprising structure for pivotal movement of said member about an axis transverse to the longitudinal axis of the member.

2. The device of claim 1, said coupling means comprising structure defining an elongated, upright slot in said housing, and pin means carried by said cover and slidable within said slot.

3. The device of claim 1, including an apertured seat panel supported by said bowl and removable therefrom.

4. The device of claim 1, said housing including a pair of spaced, opposed, upstanding walls respectively located on opposite sides of said bowl and extending upwardly above said bowl to define a region therebetween where said child may sit.

5. The device of claim 1, including structure defining an open-top supply chamber adjacent said housing, a top, and hinge means operatively securing said top to said supply chamber-defining structure.

6. The device of claim 5, said supply chamber-defining structure including a pair of upright, opposed, spaced apart walls, said hinge means including structure for selective and alternate coupling of the top to each of said walls whereby the top may be opened in opposite directions at the discretion of the user.

7. The device of claim 6, said hinge means including a slotted hinge body operatively coupled to said top and including a pin, said supply chamber-defining structure having a pin-receiving opening adjacent each of said walls.

8. A child's toilet training device comprising:

a toilet training bowl;

means for supporting and removably covering said bowl, and for allowing selective access thereto by a child to be toilet trained, said supporting and covering means including— walls defining an upright, open-top housing for removably supporting said bowl therein;

a cover; and means operably coupling said cover to said housing for selective movement of the cover between an extended position in covering relationship over said bowl and a retracted position allowing a child to sit above the bowl, said coupling means comprising structure for translatory, shifting movement of said cover between said extended and retracted positions thereof;

structure defining an open-top supply chamber adjacent said housing;

a top; and hinge means operatively securing said top to said supply chamber-defining structure, said supply chamber-defining structure including a pair of upright, opposed, spaced apart walls, said hinge means including structure for selective and alternate coupling of said top to each of said walls whereby said top may be opened in opposite directions at the discretion of the user.

9. A child's toilet training device comprising:

a toilet training bowl;

means for supporting and removably covering said bowl, and for allowing selective access thereto by a child to be toilet trained, said supporting and covering means including— walls defining an upright, open-top housing for removably supporting said bowl therein;

an elongated, arcuate in cross-section cover; and means operably coupling said cover to said housing for selective movement of the cover between an extended position in covering relationship over said bowl and a retracted position allowing a child to sit above the bowl, said coupling means comprising structure for pivoting movement of the cover about an axis transverse to the longitudinal axis of the cover, and for translatory, shifting movement of said cover between said extended and retracted positions thereof; and structure defining an open-top supply chamber adjacent said housing, a top, and hinge means operatively securing said top to said supply chamber-defining structure, said hinge means including structure for pivotal movement of said top about a pivot axis transverse to said cover pivot axis.

10. The device of claim 9, said coupling means comprising structure defining an elongated, upright slot in said housing, and pin means carried by said cover and slidable within said slot.

11. The device of claim 9, said housing including a pair of spaced, opposed, upstanding walls respectively located on opposite sides of said bowl and extending upwardly above said bowl to define a region therebetween where said child may sit.

12. The device of claim 9, said supply chamber-defining structure including a pair of upright, opposed, spaced apart walls, said hinge means including structure for selective and alternate coupling of the top to each of said walls whereby the top may be opened in opposite directions at the discretion of the user.

13. The device of claim 12, said hinge means including a slotted hinge body operatively coupled to said top and including a pin, said supply chamber-defining structure having a pin-receiving opening adjacent each of said walls.

14. The device of claim 9, said top being disposed below said cover when the top and cover are in overlying relationship to said bowl and chamber respectively.

15. The device of claim 9, including wheel means secured to the underside of said device for rendering the device mobile.

16. The device of claim 9, including an apertured seat panel supported by said bowl and removable therefrom.

* * * * *